US009270071B2

(12) United States Patent
Abraham et al.

(10) Patent No.: US 9,270,071 B2
(45) Date of Patent: Feb. 23, 2016

(54) MICROWAVE CONNECTOR WITH FILTERING PROPERTIES

(71) Applicant: International Business Machines Corporation, Armonk, NY (US)

(72) Inventors: David W. Abraham, Cronton, NY (US); Antonio D. Corcoles Gonzalez, Mount Kisco, NY (US); James R. Rozen, Peekskill, NY (US)

(73) Assignee: International Business Machines Corporation, Armonk, NY (US)

( * ) Notice: Subject to any disclaimer, the term of this patent is extended or adjusted under 35 U.S.C. 154(b) by 264 days.

(21) Appl. No.: 13/799,651

(22) Filed: Mar. 13, 2013

(65) Prior Publication Data

US 2014/0266496 A1 Sep. 18, 2014

(51) Int. Cl.

| | |
|---|---|
| ***H01P 5/04*** | (2006.01) |
| ***H01P 1/04*** | (2006.01) |
| ***H01R 43/00*** | (2006.01) |
| ***H01R 24/42*** | (2011.01) |
| ***H01P 1/202*** | (2006.01) |
| *H01R 13/7197* | (2011.01) |

(52) U.S. Cl.

CPC ..... *H01R 43/00* (2013.01); *H01P 1/045* (2013.01); *H01P 1/202* (2013.01); *H01R 24/42* (2013.01); *H01R 13/7197* (2013.01); *Y10T 29/49204* (2015.01)

(58) Field of Classification Search

CPC ..... H01P 1/04; H01P 1/045; H01P 1/06; H01P 1/202; H01R 24/40; H01R 43/00

USPC ..... 333/260, 33

See application file for complete search history.

(56) References Cited

U.S. PATENT DOCUMENTS

| | | | |
|---|---|---|---|
| 3,292,117 | A | 12/1966 | Bryant |
| 3,492,604 | A | 1/1970 | Fan |
| 3,638,147 | A | 1/1972 | Denes |
| 3,909,759 | A | 9/1975 | Ouellette et al. |
| 4,366,457 | A | 12/1982 | Bode |
| 4,625,187 | A | 11/1986 | Bocher |
| 5,367,956 | A | 11/1994 | Fogle, Jr. |
| 5,499,935 | A | 3/1996 | Powell |
| 5,509,827 | A | 4/1996 | Huppenthal |
| 5,796,323 | A | 8/1998 | Uchikoba et al. |
| 6,595,802 | B1 | 7/2003 | Watanabe et al. |

(Continued)

FOREIGN PATENT DOCUMENTS

CN 102751633 A 10/2012

OTHER PUBLICATIONS

International Search Report issued in PCT/US2014/012239 on May 12, 2014; 7 pages.

(Continued)

*Primary Examiner* — Stephen E Jones
*Assistant Examiner* — Scott S Outten
(74) *Attorney, Agent, or Firm* — Cantor Colburn LLP; Vazken Alexanian

(57) ABSTRACT

A microwave connector is provided. The microwave connector includes an outer conductor, an inner conductor disposed within the outer conductor and dielectric materials interposed between the outer conductor and the inner conductor, the dielectric materials including a non-dissipative dielectric material and a dissipative dielectric material.

19 Claims, 4 Drawing Sheets

(56) References Cited

U.S. PATENT DOCUMENTS

| | | | |
|---|---|---|---|
| 6,621,373 | B1 | 9/2003 | Mullen et al. |
| 7,456,702 | B2 | 11/2008 | Keefe et al. |
| 7,478,475 | B2 | 1/2009 | Hall |
| 7,532,099 | B2 | 5/2009 | Brunner |
| 2001/0002117 | A1 | 5/2001 | Schulze-Buxloh |
| 2002/0084710 | A1 | 7/2002 | Worley |
| 2003/0030514 | A1 | 2/2003 | Suma |
| 2009/0085694 | A1 | 4/2009 | Keefe et al. |
| 2011/0152104 | A1 | 6/2011 | Farinelli et al. |
| 2011/0201232 | A1 | 8/2011 | Islam |

OTHER PUBLICATIONS

Written Opinion t issued in PCT/US2014/012239 on May 12, 2014; 7 pages.

D. F. Santavicca et al., "Impedance-matched low-pass stripline filters," Measurement Science and Technology, vol. 19, No. 8, 2008, 087001, 5 pages.

D. H. Slichter et al., "Millikelvin thermal and electrical performance of lossy transmission line filters," Applied Physics Letters, vol. 94, Issue 19, 2009, 192508 , 3 pages.

K. Bladh et al., "Comparison of cryogenic filters for use in single electronics experiments," Review of Scientific Instruments, vol. 74, Issue 3, 2003, 1540721, 5 pages.

A. Lukashenko et al., "Improved powder filters for qubit measurements," Review of Scientific Instruments, vol. 79, Issue 1, 2008, 014701, 4 pages.

R. C. Richardson and E N. Smith (Eds.), "Experimental techniques in condensed matter physics at low temperatures," 1988, Addison-Wesley, Redwood City, CA, pp. 236-239.

Non-Final Office Action issued in U.S. Appl. No. 13/837,606; mailed Aug. 10, 2015; 23 pages.

MICROWAVE CONNECTOR WITH FILTERING PROPERTIES

STATEMENT OF GOVERNMENT INTEREST

This invention was made with Government support under Contract No.: W911NF-10-1-0324 awarded by Army Research Office (ARO). The Government has certain rights in this invention.

BACKGROUND

The present invention relates to a connector, and more specifically, to a microwave connector for efficient thermalization and filtering of microwave lines at millikelvin temperatures.

The use of high-frequency coaxial lines at cryogenic temperatures (i.e., temperatures below 1 K) presents a number of experimental difficulties. These difficulties are mainly related to the proper filtering of unwanted frequencies, adequate impedance matching of circuit components and optimal thermalization of the lines.

Experiments in the GHz frequency regime normally impose stringent conditions on the bandwidth within which the experiments are performed. Out-of-band spurious radiation tends to be unacceptable and proper filtering is therefore a must. Likewise, to avoid reflections of the experimental signal, which can result in signal loss, standing waves and added noise, impedance matching of all the connectors and components in the circuit is important.

For typical cryogenic setups, thermal conduction from room temperature down to the coldest stage of the refrigerator must be minimized, and thus most popular choices of coaxial lines for high frequency measurements at low temperatures involve the use of good thermal isolators like superconductors. At the same time, proper thermal anchoring of the lines at each stage of the refrigerator is a must. In coaxial lines, for example, whereas the outer conductor presents no problems for heat sinking, the efficient thermalization of the inner conductor constitutes a significant challenge, as the dielectric separating outer and inner conductors is typically an excellent thermal insulator. Different solutions exist to solve this problem, like $\lambda/4$ studs, cold attenuators, or striplines encased in epoxy, amongst others. These approaches, however, may present added difficulties in some experiments. A $\lambda/4$ stud, for example, has a very low bandwidth, whereas the effectiveness of cryogenic attenuators at millikelvin temperatures for inner conductor thermalization is somewhat unclear. Epoxy stripline filters tend to be bulky in order to avoid the dissipative side walls of the encasing to alter the field lines.

SUMMARY

According to one embodiment of the present invention, a microwave connector is provided and includes an outer conductor, an inner conductor disposed within the outer conductor and dielectric materials interposed between the outer conductor and the inner conductor. The dielectric materials include a non-dissipative dielectric material and a dissipative dielectric material.

According to another embodiment of the invention, a connector is provided and includes an outer conductor, an inner conductor having first, second and third portions, the first and second portions having similar dimensions and the third portion being interposed between the first and second portions and having a different dimension, a low-dissipative dielectric material disposed to surround the second portion of the inner conductor and a dissipative dielectric material disposed to surround the third portion of the inner conductor.

According to another embodiment of the invention, a connector is provided and includes an annular outer conductor, an inner conductor disposed within the annular conductor and having first, second and third portions, the first and second portions having similar diameters and the third portion being interposed between the first and second portions and having a different diameter, a non-dissipative dielectric material disposed to surround the second portion of the inner conductor and a dissipative dielectric material disposed to surround the third portion of the inner conductor.

According to another embodiment of the invention, a method of assembling a connector having outer and inner conductor conductors is provided. The method includes modifying a diameter of a portion of the inner conductor, pressing a low-dissipative dielectric material between the outer and inner conductors to expose the portion of the inner conductor and applying a dissipative dielectric material to the exposed portion of the inner conductor.

According to yet another embodiment of the invention, a method of assembling a connector having an annular outer conductor and an inner conductor disposed within the outer conductor is provided. The method includes modifying a diameter of a portion of the inner conductor, pressing a low-dissipative dielectric material between the outer and inner conductors such that the portion of the inner conductor is exposed, applying a dissipative dielectric material to the exposed portion of the inner conductor and curing the dissipative dielectric material.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

A microwave connector is provided for efficient thermalization and filtering of microwave lines at millikelvin temperatures. The connector is designed to operate at frequencies in the 1-20 GHz range, and has a cutoff frequency that can be tuned during fabrication as will be described below in further detail. The design allows for impedance tuning to impedance match other circuitry components and offers a high degree of miniaturization and modularity.

Figure 1:
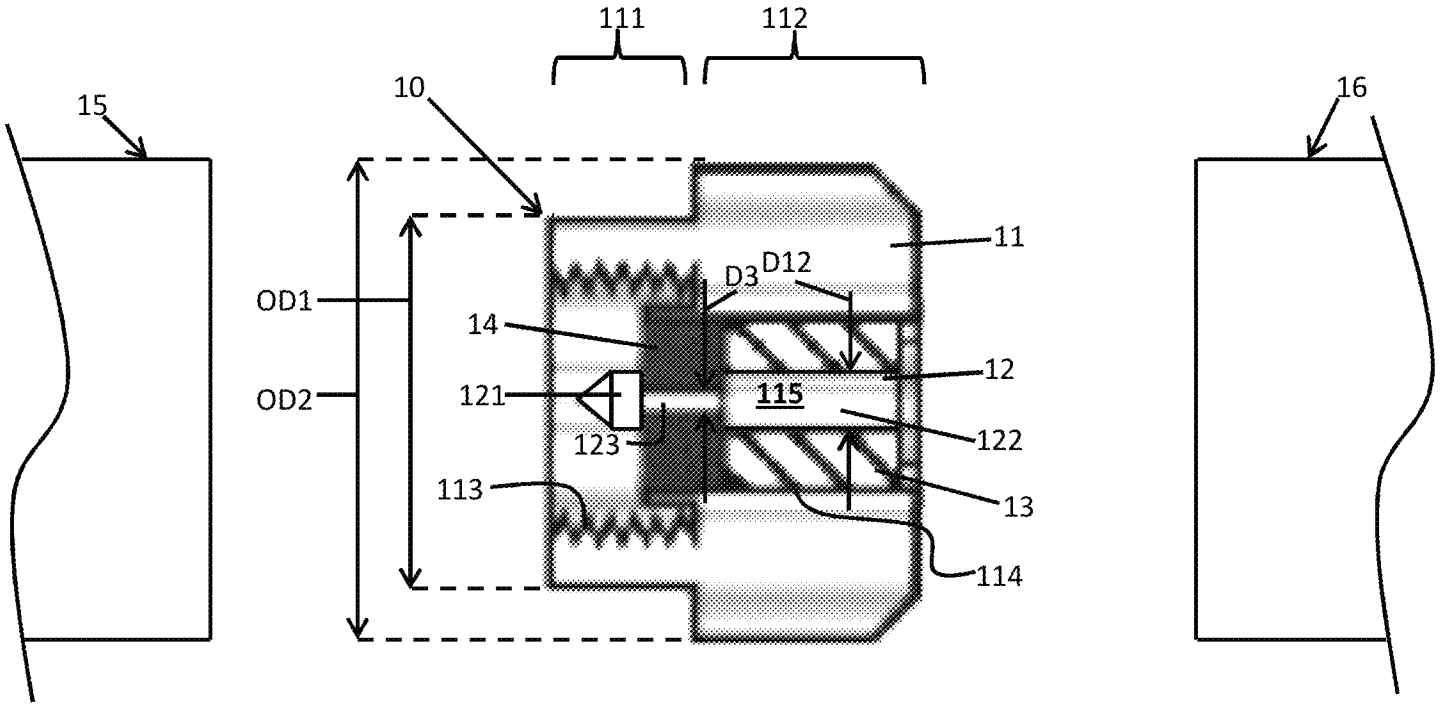
FIG. 1 is a schematic side view of a connector in accordance with embodiments.

With reference to FIG. 1, a microwave connector (hereinafter referred to as a "connector") 10 is provided. The connector 10 includes an outer conductor 11, an inner conductor 12, a low-dissipative dielectric material 13 and a dissipative dielectric material 14.

The outer conductor 11 is similar in shape and size to the outer conductor of a standard SubMiniature version A (SMA) connector and may be formed of brass, copper, stainless steel or other similar materials. The outer conductor 11 is provided with a lead portion 111 and a rear portion 112. The lead portion 111 is an annular element having a first outer diameter OD1 and threading formed on an interior surface 113 thereof. The threading is provided for connection of the connector 10 with a cable connector 15. The rear portion 112 is an annular element having a second outer diameter OD2, which is larger than the first outer diameter OD1, and a relatively smooth interior surface 114. The respective interior surfaces 113 and 114 of the lead portion 111 and the rear portion 112 define an annular interior 115.

The inner conductor 12 is disposed in the annular interior 115 of the outer conductor 11 and has a first portion 121, a second portion 122 and a third portion 123. The first and second portions 121 and 122 have similar dimensions, although this is not required. In particular, the first and second portions 121 and 122 have similar diameters D12. The third portion 123 is axially interposed between the first and second portions 121 and 122 and has a dimension, which is different from the corresponding dimensions of the first and second portions 121 and 122. In particular, the third portion 123 has a diameter D3, which is different from the diameters D12 (i.e., diameter D3 may be less than diameters D12, as shown in FIG. 1, or more than diameters D12). From a rear side of the rear portion 112 of the outer conductor 11, the second portion 122 extends axially forwardly nearly as far as the rear portion 112 of the outer conductor 11. The third portion 123 extends axially forwardly from the lead end of the second portion 122 to a midway point of the lead portion 111 of the outer conductor 11. From the lead end of the third portion 123, the first portion 121 extends axially forwardly nearly as far as the lead side of the lead portion 111 of the outer conductor 11.

With the construction described above, the threading formed on the interior surface 113 surrounds the first portion 121 and about half of the third portion 123. Similarly, the relatively smooth interior surface 114 surrounds the second portion 122 and about half of the third portion 123. This is not required, however, and it is to be understood that the axial length of the third portion 123 is defined as being a length of the inner conductor 12 that is in contact with the dissipative dielectric material 14. The axial length of the third portion 123 as defined herein determines a total dissipation. The diameter of the third portion 123, which is in contact with the dissipative dielectric material 14, may be modified to maintain a constant impedance as well as other characteristic properties.

As shown in FIG. 1, the rear end of the second portion 122 of the inner conductor 12 and the rear side of the rear portion 112 of the outer conductor 11 are respectively connectable with corresponding features of cable 16, which is attachable to the connector 10. A lead end of the first portion 121 has a pin-head shape and tapers toward a sharp lead point. The lead end of the first portion 121 of the inner conductor 12 and the lead side of the lead portion 111 of the outer conductor 11 are respectively connectable with corresponding features of the cable connector 15.

The low-dissipative dielectric material 13 is disposed to surround the second portion 122 of the inner conductor 12 and thus occupies the annular space between the outer surface of the second portion 122 of the inner conductor 12 and the relatively smooth interior surface 114 of the rear portion 112 of the outer conductor 11. In accordance with embodiments, the low-dissipative dielectric material 13 may be a non-dissipative dielectric material or, more particularly, Polytetrafluoroethylene (PTFE). The dissipative dielectric material 14 is disposed to surround the third portion 123 of the inner conductor 12 and is axially adjacent to the low-dissipative dielectric material 13. The dissipative dielectric material 14 inhabits a substantial entirety of a space between the outer conductor 11 and the inner conductor 12 with substantially no gaps defined therein.

In accordance with embodiments, the dissipative dielectric material 14 may be formed of Eccosorb™ or Eccosorb™-like materials, which include a carrier epoxy resin with inclusions of small micron-scale metallic (possibly ferromagnetic) particles. In accordance with additional or alternative embodiments, the dissipative dielectric material 14 may also include powder formed of at least one of quartz and silica to match the coefficient of thermal expansion (CTE) of the outer and inner conductors 11 and 12 and/or ferromagnetic particles. The ferromagnetic particles may include iron to provide for high frequency dissipation.

In general, a ratio of the low-dissipative dielectric material 13 to the dissipative dielectric material 14 may be set at a level associated with a predefined attenuation cutoff frequency. Also, for the dissipative dielectric material 14, a volume of the epoxy resin and an amount of the magnetic fill determines attenuation and rolloff frequencies and thus is tunable. Moreover, the diameter D3 of the third portion 123 of the inner conductor 12 is tunable for optimal impedance matching in the connector 10. This allows for minimized reflection of RF signals.

A process of assembling connector 10 will now be described. Transmission characteristics of the connector 10 are calculated and the inner conductor 12 is modified for optimal transmission characteristics with the understanding that achieving such optimal transmission characteristics requires substantially constant impedance over an axial length of the connector 10. This impedance is determined by the relative radii of the inner and outer conductors 12 and 11 and by the electric and magnetic permittivity of the dissipative and non-dissipative dielectric materials 14 and 13. In particular, the impedance, Z, is:

$$Z = \frac{1}{2\pi}\sqrt{\frac{\mu}{\varepsilon}}\ln(D/d);$$

where μ and ∈ are the magnetic permeability and dielectric constant of the dissipative and non-dissipative dielectric materials 14 and 13, D is the outer diameter of the dissipative and non-dissipative dielectric materials 14 and 13 and d is the diameter of the inner conductor 12. As D is a constant number in this invention, the parameter d is therefore changed between the dissipative and non-dissipative dielectric materials 14 and 13 to keep a constant 50Ω impedance to account for changes in μ and ∈ in the dissipative and non-dissipative dielectric materials 14 and 13.

In practice, the model described above may be fine-tuned in testing to determine an actual optimal diameter D.

Once the two different diameters for the inner conductor 12 have been determined and the inner conductor 12 has been modified as shown in FIG. 1, the non-dissipative dielectric material 13 is pressed between the outer and inner conductors 11 and 12 until one end of the non-dissipative dielectric material 13 reaches the rear side of the connector 10 and the other end aligns exactly with the step change in the inner conductor 12 diameter (i.e., the border between the second portion 122 of the inner conductor 12 and the third portion 123 of the inner conductor 12). The region over which the diameter of the inner conductor 12 is the smallest is now exposed. The dissipative dielectric material 14 is prepared separately and applied to the connector 10 while still in liquid form with a syringe or a similar method. The liquid dissipative dielectric material 14 is applied until exactly the next step in the inner conductor 12 diameter (i.e., the border between the third portion 123 of the inner conductor 12 and the first portion 121 of the inner conductor 12). The connector 10 is then left at a proper temperature for the liquid dissipative dielectric 14 to cure, which may be about 120 Celsius for a couple of hours, or whatever schedule is recommended by the manufacturer.

Figure 2:
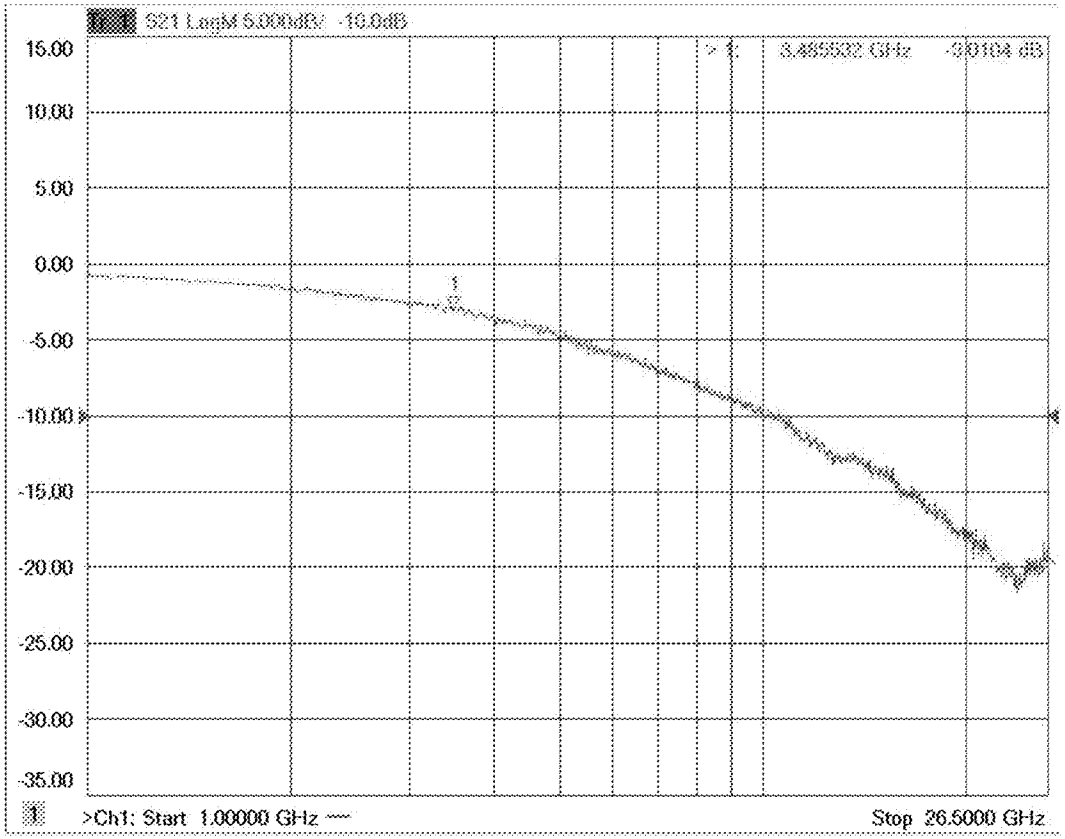
FIG. 2 is a graphical depiction of performance data for the connector of FIG. 1.

With reference to FIG. 2, a graphical depiction of performance data for the connector 10 is provided. The data of FIG. 2 was taken at room temperature and the connector 10 included ¼ dissipative dielectric material 14 and ¾ non-dissipative dielectric material 13. As shown in FIG. 2, the 3 dB point was at 3.5 GHz. Similar performance was observed at cryogenic temperatures with a 3 dB frequency.

Figure 3:
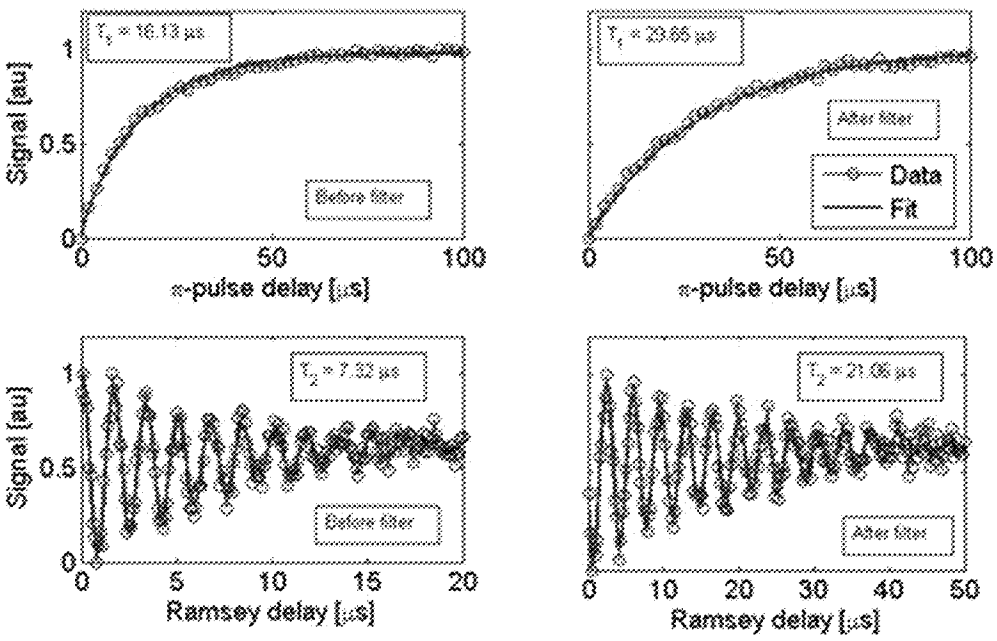
FIG. 3 is a graphical depiction of relaxation and coherence times measured in a superconducting qubit using connectors of FIG. 1 with ratios of 1:1 and 1:2 dissipative/non-dissipative dielectric materials at the input and output of the device, respectively.
Figure 4:
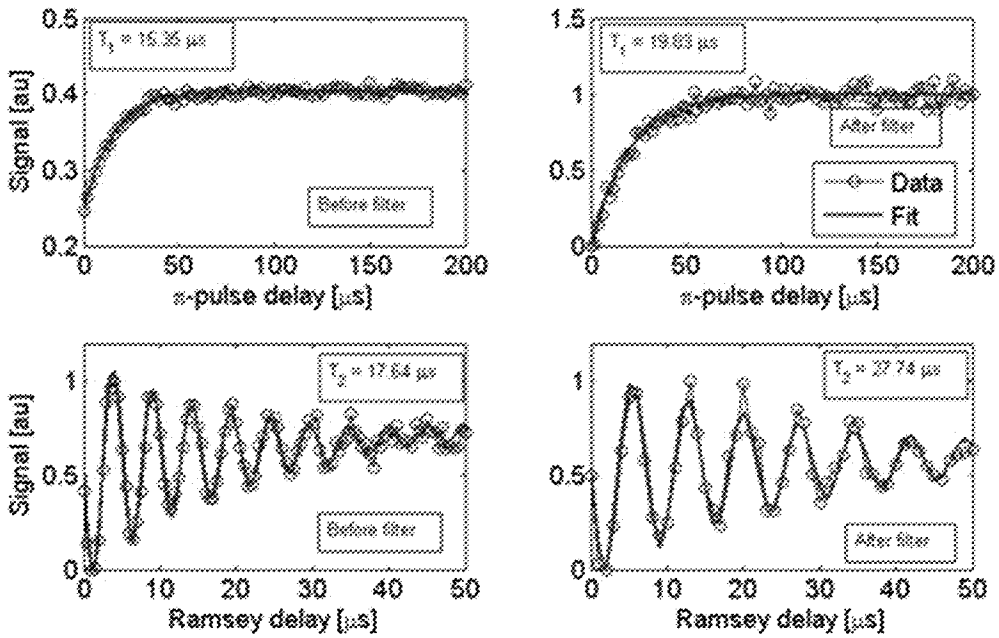
FIG. 4 is a graphical depiction of relaxation and coherence times measured in a superconducting qubit using connectors of FIG. 1 with ratios of 1:1 and 1:3 dissipative/non-dissipative dielectric materials at the input and output of the device, respectively.

With reference to FIGS. 3 and 4, a performance of the connector 10 has been tested with superconducting qubits (i.e., a quantum bit as used in superconducting quantum computing). Superconducting quantum computing is an implementation of quantum information that involves nanofabricated superconducting electrodes. A qubit is a two-state quantum-mechanical system, such as the polarization of a single photon, where the qubit allows for a superposition of both states at the same time. There are a number of possible experimental implementations of qubits. In a particular case of superconducting qubits, a quantum system is fabricated out of superconducting structures and a non-linear, non-dissipative element called the Josephson junction. A Josephson junction is a thin (nm size) insulating barrier between two superconductors and acts mainly as a non-linear inductor, which results in a unequal spacing of the energy levels of the qubit. This differentiates the qubit from a purely harmonic oscillator and allows the experimental manipulation of the corresponding two unique quantum states.

A qubit in thermodynamic equilibrium with its environment will ideally be in its ground state. When the quantum state of the qubit is manipulated to perform any operation on it, the system will eventually evolve towards thermodynamic equilibrium, a process called relaxation, over a characteristic time (T1, or relaxation time). Through the T1 relaxation process, the qubit exchanges energy with the environment. Another dynamical process in a qubit concerns the quantum phase between the two states of the qubit. The ability to experimentally describe the relative phase between those states is called coherence. Coherence is a key concept in quantum information and it is at the core of the theory. A quantum system typically loses coherence by interacting with the environment in an irreversible way. This does not necessarily involve an energy exchange with the environment, as T1 does. Through decoherence, a quantum system evolves from a pure superposition of two quantum states to a classical mixture of those states (a description of the states without any relative phase information). The characteristic timescale over which a quantum system loses coherence is called T_phi. This is not, however, what is typically called 'coherence time'. Coherence time, or T2, is defined as (1/(2T1)+1/T_phi)^(−1). This reflects the fact that the effective lifetime of a qubit depends on the rate at which the qubit losses energy via its environment (T1) and on the rate at which the qubit loses phase coherence (T_phi).

In FIG. 3, the relaxation (top) and coherence (bottom) times of the superconducting qubit are shown both before and after using a connector with a 1:1 epoxy:teflon ratio (i.e., the ratio of dissipative dielectric material 14 to non-dissipative dielectric material 13) at the input and with 1:2 epoxy:teflon ratio at the output of the device. In FIG. 4, the relaxation (top) and coherence (bottom) times of the superconducting qubit are shown both before and after using a connector with a 1:1 epoxy:teflon ratio at the input and with 1:3 epoxy:teflon ratio at the output of the device.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A connector, comprising:

an annular outer conductor comprising a rear portion having a leading end and a lead portion having a trailing end and a smaller diameter than the rear portion;

an inner conductor disposed coaxially within the annular outer conductor and having first, second and third portions, the first and second portions having similar diameters and the third portion being interposed between the first and second portions and having a smaller diameter than the first and second portions;

a non-dissipative dielectric material disposed to be surrounded by the rear portion of the annular outer conductor and to surround the second portion of the inner conductor; and a dissipative dielectric material disposed to be surrounded by the leading and trailing ends of the rear and lead portions of the annular outer conductor, respectively, and to surround the third portion of the inner conductor.

2. The connector according to claim 1, wherein the dissipative dielectric material comprises epoxy resin.

3. The connector according to claim 2, wherein the dissipative dielectric material further comprises powder formed of at least one of quartz, silica and ferromagnetic particles.

4. The connector according to claim 2, wherein the dissipative dielectric material inhabits substantial entirety of a space between the outer conductor and the inner conductor.

5. The connector according to claim 1, wherein a ratio of the non-dissipative dielectric material to the dissipative dielectric material is set at a level associated with a predefined attenuation cutoff frequency.

6. The connector according to claim 1, wherein the first portion of the inner conductor has a pin-head shape.

7. The connector according to claim 1, wherein the outer conductor and the second portion of the inner conductor are configured to be electrically coupled to an outer conductor and an inner conductor of a coaxial cable, respectively.

8. The connector according to claim 1, wherein a diameter of the third portion of the inner conductor is tuned for impedance matching.

9. A connector, comprising:

an outer conductor comprising a rear portion having a leading end and a lead portion having a trailing end and a smaller diameter than the rear portion;

an inner conductor disposed coaxially within the outer conductor and having first, second and third portions, the first and second portions having similar diameters and the third portion being interposed between the first and second portions and having a smaller diameter than the first and second portions;

a low-dissipative dielectric material disposed to be surrounded by the rear portion of the outer conductor and to surround the second portion of the inner conductor; and a dissipative dielectric material disposed to be surrounded by the leading and trailing ends of the rear and lead portions of the outer conductor, respectively, and to surround the third portion of the inner conductor.

10. The connector according to claim 9, wherein the dissipative dielectric material comprises epoxy resin.

11. The connector according to claim 10, wherein the dissipative dielectric material further comprises powder formed of at least one of quartz, silica and ferromagnetic particles.

12. The connector according to claim 9, wherein a ratio of the low-dissipative dielectric material to the dissipative dielectric material is set at a level associated with a predefined attenuation cutoff frequency.

13. The connector according to claim 9, wherein the outer conductor and the second portion of the inner conductor are configured to be electrically coupled to an outer conductor and an inner conductor of a coaxial cable, respectively.

14. The connector according to claim 9, wherein the diameter of the third portion of the inner conductor is tuned for impedance matching.

15. A microwave connector, comprising:

an outer conductor comprising a rear portion and a lead portion having a smaller diameter than the rear portion;

an inner conductor disposed coaxially within the outer conductor and comprising a first portion, a second portion and a third portion between and having a smaller diameter than the first and second portions; and dielectric materials interposed between the outer conductor and the inner conductor, the dielectric materials comprising:

a non-dissipative dielectric material interposed between the rear portion of the outer conductor and the second portion of the inner conductor; and a dissipative dielectric material interposed between the third portion of the inner conductor and leading and trailing ends of the rear and lead portions of the outer conductor, respectively.

16. The microwave connector according to claim 15, wherein the microwave connector is designed for operation in the 1-20 GHz range.

17. The connector according to claim 15, wherein the diameter of the third portion promotes impedance matching.

18. The connector according to claim 15, wherein the dissipative dielectric material inhabits a substantial entirety of a space between the third portion of the inner conductor and the leading and trailing ends of the rear and lead portions of the outer conductor, respectively.

19. The connector according to claim 15, wherein the dissipative dielectric material comprises at least one of quartz, silica and ferromagnetic particles.

* * * * *